US007409806B1

(12) United States Patent
Hilger

(10) Patent No.: US 7,409,806 B1
(45) Date of Patent: Aug. 12, 2008

(54) METHOD OF REPAIRING WOOD ROT IN STRUCTURAL MEMBERS

(75) Inventor: Mathias G. Hilger, Garden Plain, KS (US)

(73) Assignee: Sill Saver Plus, Wichita, KS (US)

( * ) Notice: Subject to any disclaimer, the term of this patent is extended or adjusted under 35 U.S.C. 154(b) by 665 days.

(21) Appl. No.: 10/957,995

(22) Filed: Oct. 4, 2004

(51) Int. Cl.
*E04B 1/00* (2006.01)

(52) U.S. Cl. ..... 52/741.1; 52/514

(58) Field of Classification Search ..... 52/741.1, 52/472.1, 514, 514.5, 742, 514.51
See application file for complete search history.

(56) References Cited

U.S. PATENT DOCUMENTS

| | | | | |
|---|---|---|---|---|
| 892,880 | A * | 7/1908 | Orr | 52/514 |
| 3,390,951 | A | 7/1968 | Finger et al. | |
| 3,900,541 | A | 8/1975 | Klapwijk | |
| 4,306,821 | A | 12/1981 | Moore | |
| 4,779,389 | A | 10/1988 | Landers | |
| 4,865,879 | A | 9/1989 | Finlay | |
| 4,892,601 | A | 1/1990 | Norwood | |
| 4,905,441 | A | 3/1990 | Landers | |
| 4,918,883 | A | 4/1990 | Owen et al. | |
| 4,921,555 | A | 5/1990 | Skiff | |
| 5,245,812 | A | 9/1993 | Landers | |
| 5,440,859 | A | 8/1995 | Cortese | |
| 6,425,222 | B1 | 7/2002 | Hagel | |
| 6,694,696 | B2 | 2/2004 | Hagel | |

OTHER PUBLICATIONS web.archive.org/web/20020614155212/http://alsnetbiz.com/homeimprovement/woodrot_repair.html.*
web.archive.org/web/20020210091638/http://www.factsfacts.com/MyHomeRepair/rotrepair.htm.*

* cited by examiner

*Primary Examiner*—Richard E. Chilcot, Jr.
*Assistant Examiner*—Jessica Laux
(74) *Attorney, Agent, or Firm*—Stinson Morrison Hecker LLP; Mark C. Young

(57) ABSTRACT

A method of repairing wood rot in a structural member. In an exemplary method, rotted material is removed from the structural member to create a repair area. The repair area is treated with a fungicide to kill the fungus that causes the wood rot, and at least one reinforcement member is placed in the repair area. The repair area is filled with filler material to complete the repair.

9 Claims, 5 Drawing Sheets

METHOD OF REPAIRING WOOD ROT IN STRUCTURAL MEMBERS

CROSS-REFERENCE TO RELATED APPLICATIONS

Not Applicable.

STATEMENT REGARDING FEDERALLY SPONSORED RESEARCH OR DEVELOPMENT

Not applicable.

BACKGROUND OF THE INVENTION

1. Field of the Invention

The present invention relates to the field of structural member repair, and more specifically to the repair of wood rot in structural members.

2. Description of Related Art

In addition to being unsightly, damaged or decayed structural members in buildings or structures can be dangerous. Left unrepaired, the damaged member will further deteriorate and allow additional damage to the entire structure. Particularly in residential structures, damage due to wood rot or decay allows water incursion into other areas of the structure. In areas around windows, for example, rotted sill or sash pieces not only lessen the structural integrity of the window unit, they also allow moisture to permeate into wall cavities, causing further damage to the entire residence.

While simple methods of repairing damaged or rotted areas in structural members are known, these methods are primarily cosmetic in nature, and do nothing to restore strength to the damaged structural member nor to eliminate the source of the damage or prevent the rot from spreading. For instance, it is known in the art to repair a rotted area of a wooden member by removing the rotted material from the member and filling the resulting void with body filler or wood putty. After being shaped and painted, the repaired area blends into the original member and the area appears to be fixed. However, such a repair has not added strength to the damaged structural member, nor has it addressed the source of the problem that initially caused the damage. Thus, such cosmetic repairs have a high failure rate as the wood rot continues to spread through the structural member, and the cosmetic repair often degrades after it is exposed to structural forces.

Thus, there remains a need in the art for a method of repairing rotted structural members that restores strength to the structural member and that minimizes further damage to the structure.

BRIEF SUMMARY OF THE INVENTION

The present invention is directed to a method of repairing a damaged structural member that strengthens the damaged member and diminishes the source of the damage. The method involves identifying and removing rotted or defective material from the structural member, applying structural reinforcement within the damaged area, and filling the damaged area. Optionally, the damaged area may be treated to diminish spreading of the damage; and hardened prior to applying the structural reinforcement.

In an exemplary method, the rotted material is removed from the decayed structural members, leaving a repair area. The repair area is treated with a fungicide to kill the fungus that propagates the wood rot, and a hardener is applied to harden the wood fibers in the repair area. Screws and wire are placed in the repair area to form a structural reinforcement between adjoining structural members and to provide a support structure to later-applied filler material. Filler material is placed within the repair area and shaped to conform to the surfaces of the structural members. After priming and painting, the repaired structural members appear as original, have structural strength equal to or greater than the original members, and the source of the wood rot has been diminished.

In another aspect of the invention, a protective tent is provided that allows repairs to be made in inclement weather, protecting the repair area from damage and moisture while repairs are underway.

The terms "approximately" as used herein may be applied to modify any quantitative representation which could permissibly vary without resulting in a change in the basic function to which it is related. For example, the screws placed into the repair area spaced at approximately one-half inch may permissibly vary from that spacing if the variance does not materially alter the capability of the invention. Likewise, the variance from any quantitative representation, such as proximate or adjacent as used herein, is permissible if the variance does not materially alter the capability of the invention.

Additional aspects of the invention, together with the advantages and novel features appurtenant thereto, will be set forth in part in the description which follows, and in part will become apparent to those skilled in the art upon examination of the following, or may be learned from the practice of the invention. The objects and advantages of the invention may be realized and attained by means of the instrumentalities and combinations particularly pointed out in the appended claims.

BRIEF DESCRIPTION OF THE DRAWINGS

The method of the present invention will be described in greater detail in the following detailed description of the invention with reference to the accompanying drawings that form a part hereof, in which.

DETAILED DESCRIPTION OF THE INVENTION

The present invention is directed to a method of repairing wood rot damaged structural members. In accordance with this method, rotted material is identified and removed from the structural member to form a repair area. The repair area is treated with a fungicide comprising a mixture of water and muriatic acid to kill the fungus that propagates wood rot, and structural reinforcement members are placed within the repair area. The repair area is then filled with filler material that is shaped and finished to complete the repair. One skilled in the art will understand that the method of the present invention may be used to repair a variety of different types of structural members used in a variety of applications. For example, the method may be used to repair window frames or sashes, as well as other structural members such as pillars, siding, fascia trim, or molding which have been damaged by wood rot.

As used herein, wood rot, also known as dry rot, refers to the decay of wood due to the growth of any of various types of fungi on the wood. The fungi propagate by the release of dust-sized spores which scatter through the atmosphere, settling on any surfaces they encounter. When settled upon a hospitable surface, such as wood, the spores germinate, sending thread-like filaments called hyphae into the wood. Enzymes secreted by the hyphae break down the organic material in the wood, the fungi use the broken-down material for food to further propagate. Propagation of the fungi requires water, oxygen, organic material, and a suitable temperature range, typically in the forty to one-hundred degree Fahrenheit range.

The method of the present invention diminishes the fungi responsible for the propagation of the wood rot by killing the fungi and eliminating the conditions that favor the propagation of the fungi. The method additionally restores structural and cosmetic integrity to the wood rot damaged structural member, making the repair permanent and unnoticeable.

Figure 1:
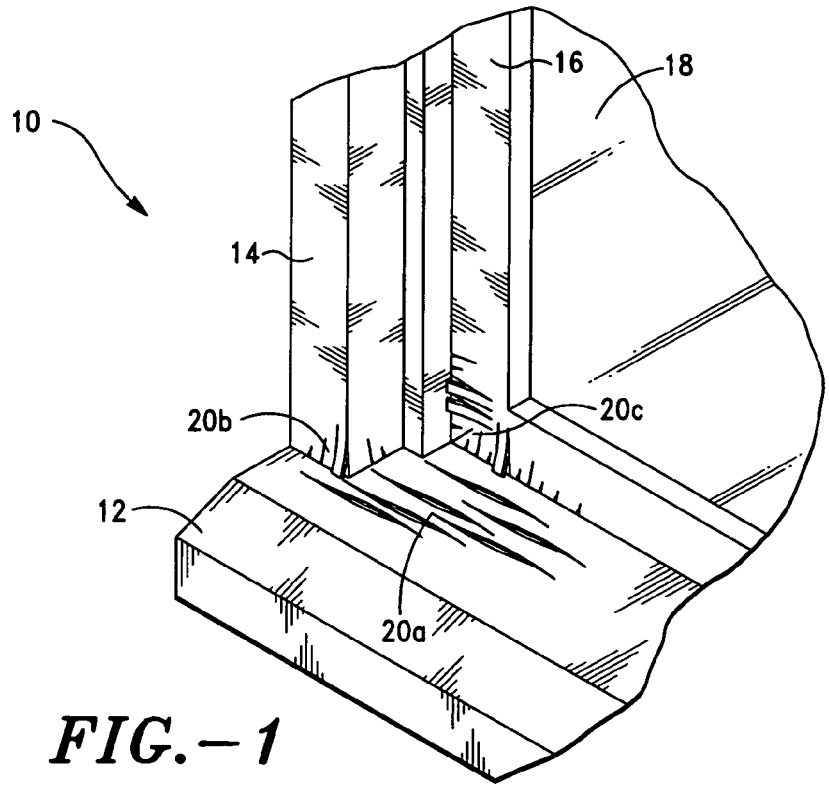
FIG. 1 is a perspective fragmented view of a window unit having a damaged area subject to repair in accordance with the method of the present invention.

Referring to FIG. 1, the method of the present invention will now be described with reference to an exemplary window structure designated generally as numeral 10. Window structure 10 includes a sill 12, an exterior window trim piece 14, a sash 16, and a window pane 18. Rotted areas can be identified by imperfections and blemishes in the surface of the structural member, or, in more extreme cases, visible cracks and voids in the structural member and the crumbled, decayed appearance of the wood. Rotted areas typically crumble to the touch, and often feel damp to the touch. As shown in FIG. 1, areas of rotted wood 20*a*, 20*b*, 20*c*, are present in sill 12, trim piece 14, and sash 16, respectively.

Figure 2:
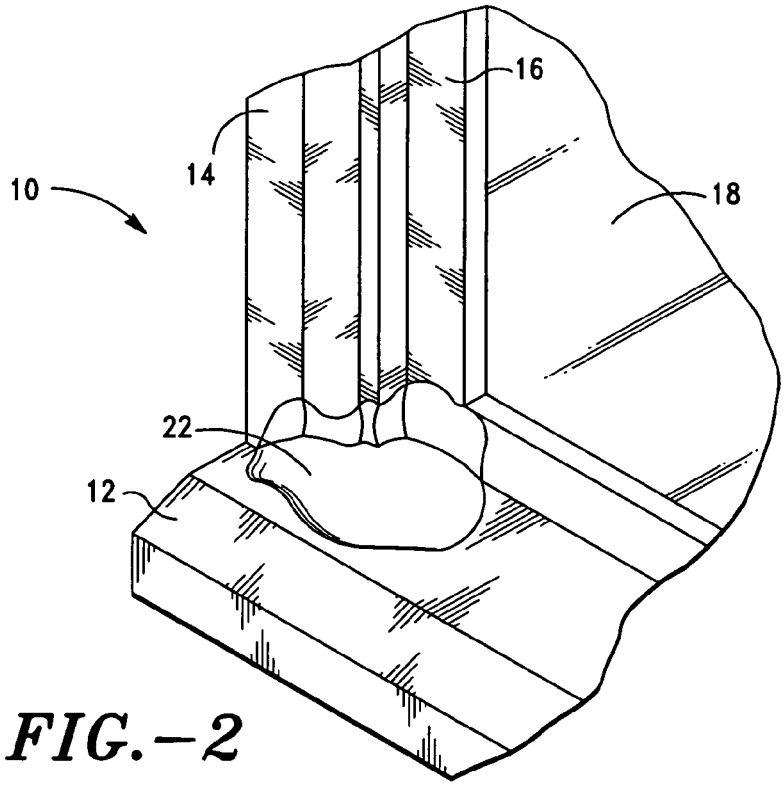
FIG. 2 is a perspective fragmented view of the window unit of FIG. 1 wherein the rotted material has been removed to leave a repair area in accordance with the method of the present invention.

Turning now to FIG. 2, repairing wood rot in accordance with the method of the present invention requires removing rotted material from all of the structural members (sill 12, trim piece 14, and sash 16) to create a repair area 22. Rotted material is separated from the structural members using any appropriate tools such as scrapers, tools, picks, or chisels. Different tools may be used depending upon the degree of decay and the available room to work in the area. Of course, other tools to remove the rotted material may be employed without deviating from the scope of the present invention For example, rotted material may be also be cut from the structural members using saws, utility knives, or rotary cutting tools. Other appropriate tools will be apparent to those skilled in the art.

After removing rotted material from the structural members, any loose material is removed from repair area 22 by vacuuming or blowing with compressed air to leave a clean, dust-free repair area 22. Equipment such as a shop-vacuum or portable air compressor are suitable for removing the loose material. After the loose material is removed, repair area 22 is allowed to dry so that no moisture remains to propagate the fungi spores in the repair area. Drying of the area can be accelerated by blowing repair area 22 with compressed air. When performing repairs at temperatures of less than fifty degrees Fahrenheit, drying can be further accelerated by using a heat gun or hair dryer to dry repair area 22. Of course, other methods of drying the area may be used without varying from the present invention.

After the rotted material has been removed from the structural members, repair area 22 is treated with fungicide to kill the fungi and stop the spread of the wood rot. Any fungicide capable of killing fungi is considered suitable for this purpose. Preferably, the fungicide is a mixture of water and muriatic acid sprayed onto the entire repair area. If the repair area is dry to the touch, the fungicide preferably comprises one part muriatic acid to two parts water. If the repair area is damp, the fungicide preferably comprises two parts muriatic acid to one part water. Most preferably, the fungicide is two parts muriatic acid to one part water. Application of the fungicide kills the fungi and spores, causing a visible discoloration in the exposed wood in repair area 22. Other fungicides and methods of application may be used without deviating from the scope of the present invention. For instance, boric acid may be used, and the fungicide may be applied using a brush or the like.

After allowing the stabilized repair area 22 to dry, a hardener is applied to repair area 22 to harden the exposed wood fibers. Most preferably, the hardener is a penetrating liquid epoxy. Minwax® brand wood hardener has been found to provide good results, although other brands may also be employed. Likewise, other types of wood hardeners may be used without varying from the present invention. The hardener is sprayed or brushed onto the entire exposed area of repair area 22 to harden the wood fibers. The hardener is allowed to dry, preferably for two to four hours.

Figure 3:
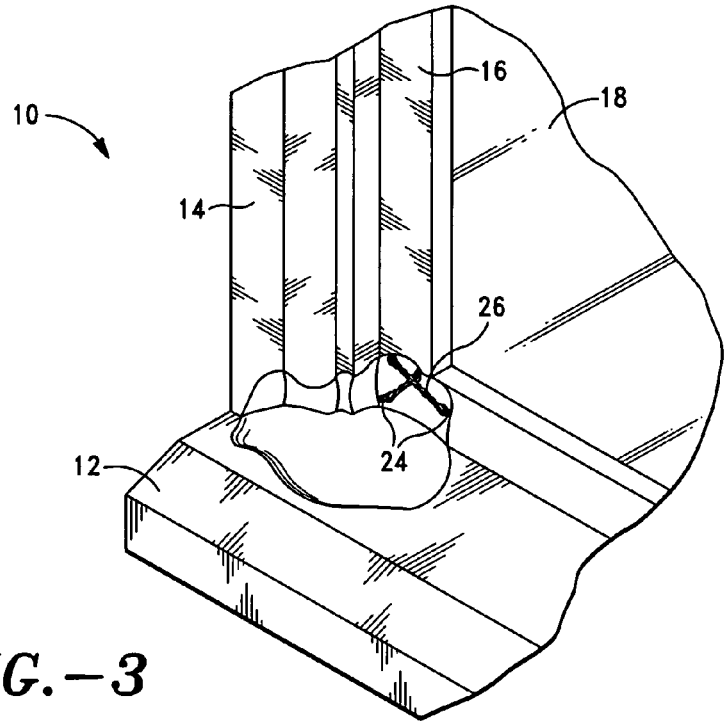
FIG. 3 is a perspective fragmented view of the window unit of FIG. 2 wherein structural reinforcement has been placed within the repair area in accordance with the method of the present invention.

Looking now to FIGS. 3 and 4, structural reinforcement members in the form of screws 24 and wires 26 are placed into repair area 22 to provide strength to window unit 10 and to provide structure to hold filler material to be applied in a later step. The size of screws 24 is determined by the depth of repair area 22 in a specific application. Typical sill 12 and sash 16 repair areas use screws sized from #6 to #10, in various lengths ranging from one inch to three inches. Preferably, screws 24 are made from a non-corrosive material, most preferably they are zinc-oxide coated. While the screws shown are eye screws, other screws such as pan head, flat head, or wood screws may be used.

Screws 24 are driven into the solid portions of each structural member (sill 12, trim piece 14, and sash 16), with spacing of approximately one-half inch maintained between adjacent screws. Preferably, the spacing between adjacent screws 24 does not exceed one-half inch. Screws 24 are driven into the structural member such that they are securely held in the structural member, and such that the heads of the screws do not project beyond the level of the surface of the structural member. Wire 26 is attached between the screws to form an elevated structure in repair area 22. Wire 26 may be wrapped or twisted around the heads of screws 24 or through the eyes of the screws, and is routed between the screws such that the wire 26 is elevated from the wood material in repair area 22. Preferably, wire 26 is galvanized, most preferably it is 18 gauge, solid galvanized.

Figure 4:
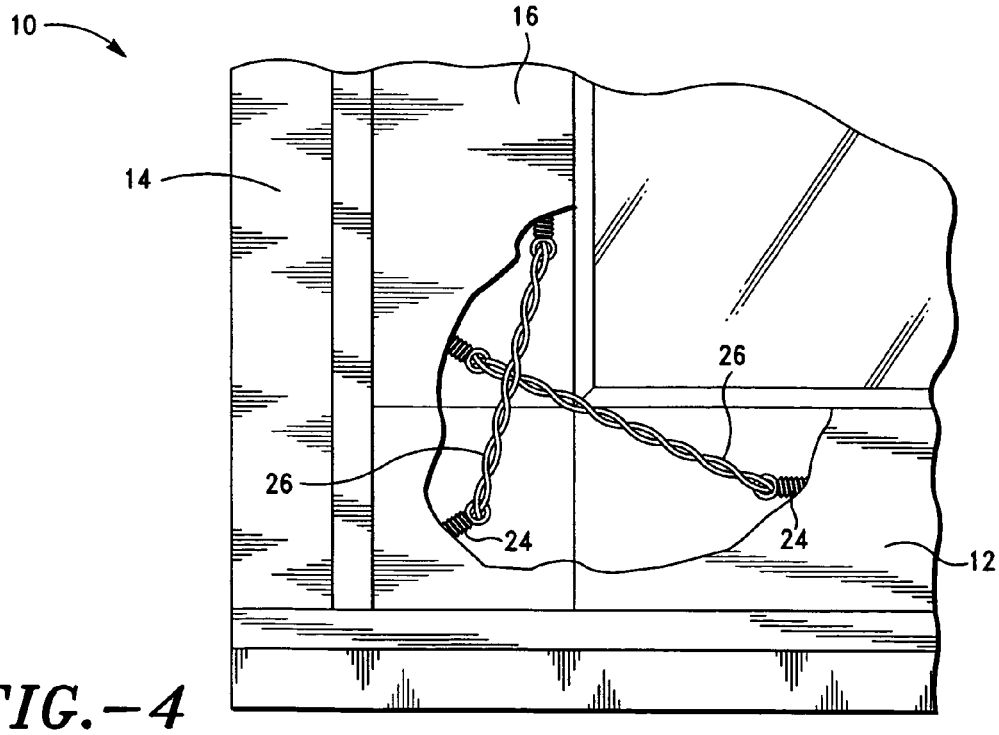
FIG. 4 is an enlarged front view of the repair portion of the window unit of FIG. 3.

As best seen in FIG. 4, wire 26 attached between screws 24 in adjacent structural members (sill 12, trim piece 14, and sash 16) further provide structural support between the adjacent members. Wire 26 may be pulled taut between screws in adjacent members to place a tension force on the wire, holding the adjacent pieces together. Thus, the screws 24 and wire 26 provide structural strength to the entire window unit 10 structure. Of course, other structural reinforcement materials may be used, such as nails, brads, staples, braided wire, or reinforcing bars. Other suitable materials will be apparent to those skilled in the art and are contemplated by the present invention.

Figure 5:
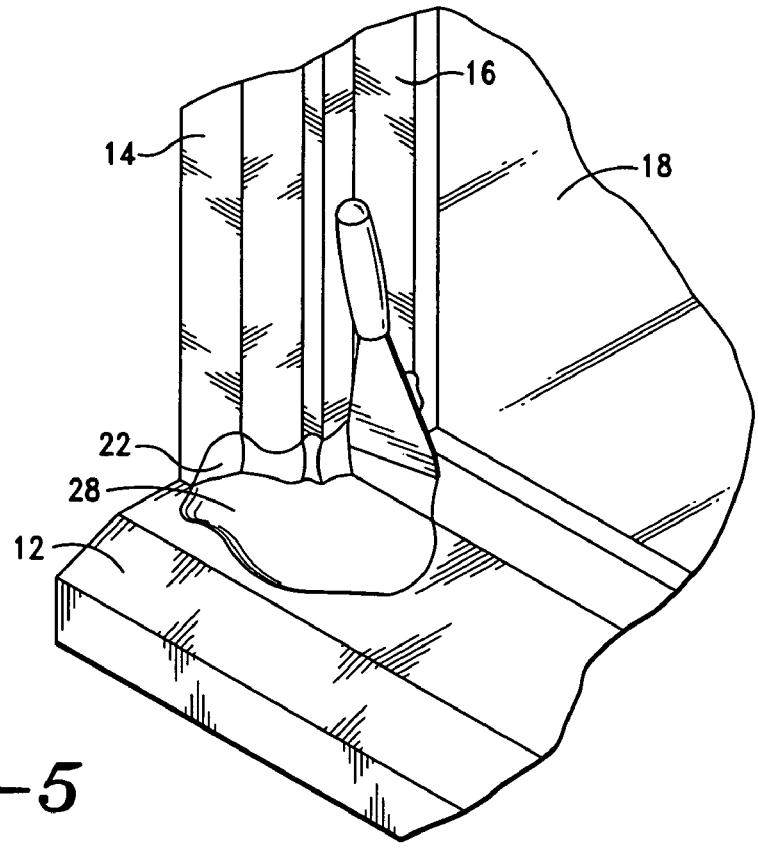
FIG. 5 is a perspective fragmented view of the window unit of FIG. 3 wherein filler material is being placed within the repair area in accordance with the method of the present invention.

Turning now to FIG. 5, repair area 22 is filled with a filler material to complete the repair. Filler material 28 is preferably a body filler or wood putty. Bondo® Home Solutions and Minwax® brand fillers have been found to be most suitable, although any other brand having comparable specifications may also be used. A putty knife, spatula, or other appropriate tool is used to apply filler material 28 into repair area 22. The tools are preferably coated with a non-stick cooking spray to facilitate easy application of the filler material. Filler material 28 sets very quickly, thus the filler material should be applied quickly. Repair area 22 should be filled so that excess material extends beyond the surface of the structural members. The excess material will later be cut down to conform to the surface of the structural members. Aluminum foil may be used between individual structural members (sill 12, trim piece 14, sash 16) so that the members are maintained as separate pieces.

After filler material 28 has dried, it is shaped to conform to the surface of the structural members using sanders, rasps, files, planes, or any other appropriate shaping tool. The final finish of filler material should be made using sixty grit or finer sandpaper. The sanded filler material is then ready for final finishing using primer and paint.

Figure 6:
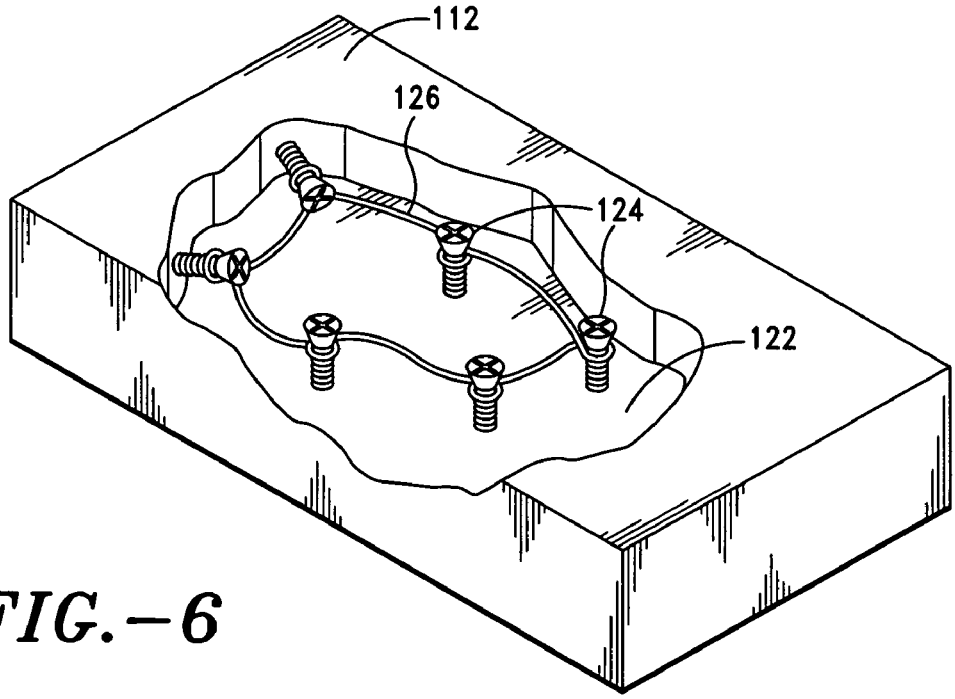
FIG. 6 is a perspective view of a structural member wherein rotted material has been removed and structural reinforcement has been placed in accordance with the method of the present invention.

As seen in FIG. 6, the method of the present invention may be applied to repair voids or rotted areas in single structural members. A structural member 112 with a void or rotted area has any decayed material removed, leaving a repair area 122. Screws 124 are placed into repair area 122, with wire 126 wrapped around and extending between adjacent screws to form an elevated structure. The screws 124 and wire 126 provide a reinforcing structure, similar to reinforcing rod used in concrete, to provide strength to a later applied filler material.

Figure 7:
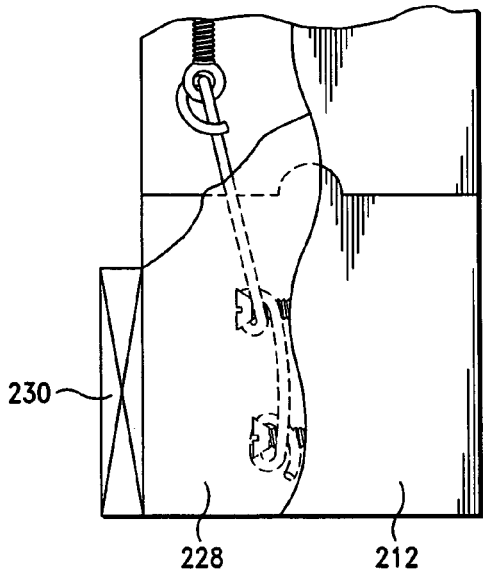
FIG. 7 is a side sectional view of two adjoining structural members wherein decayed material has been removed from each structural member, structural reinforcement has been placed, and filler material has been formed in place in accordance with the method of the present invention.

As shown in FIG. 7, a molding piece 230, preferably sprayed with a non-stick cooking spray, may be used to form or mold filler material into a desired shape. Using molding piece 230, the surface of the filler material is pre-shaped to conform to the surface of a structural member so that additional filing and shaping of the hardened filler material is greatly reduced. While molding piece 230 is shown as a flat piece, various shapes and angles may be used to conform the filler material to the shapes of various structural members.

Figure 8:
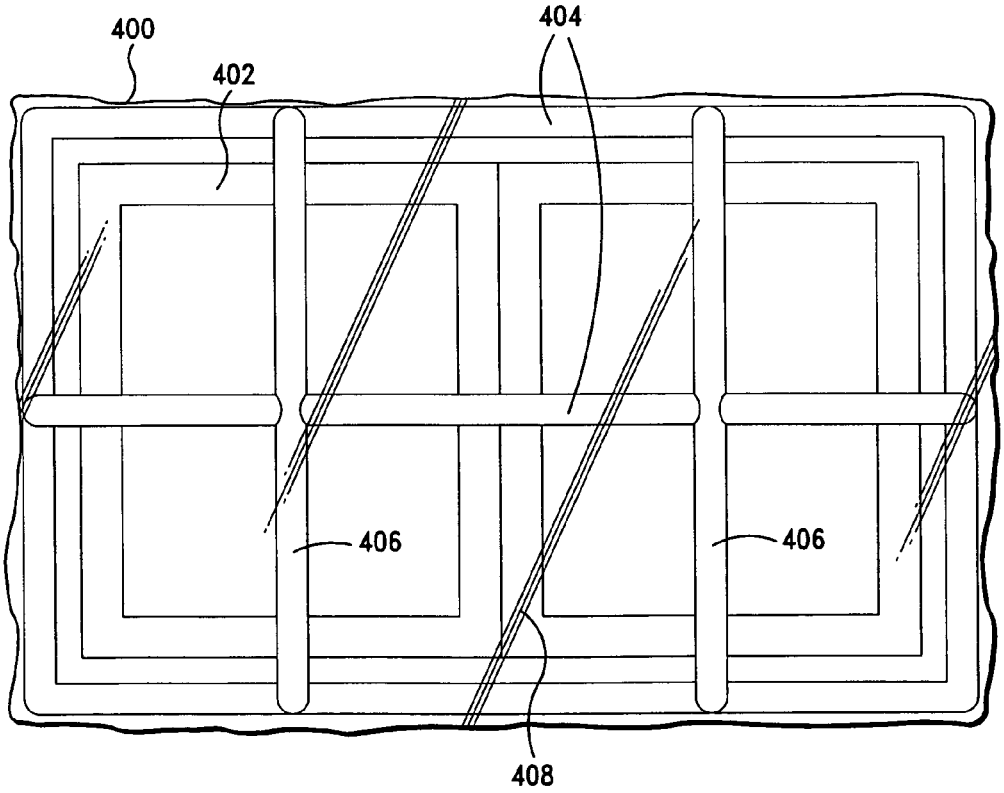
FIG. 8 is a front view of a tent structure for covering an area to be repaired in accordance with the method of the present invention.
Figure 9:
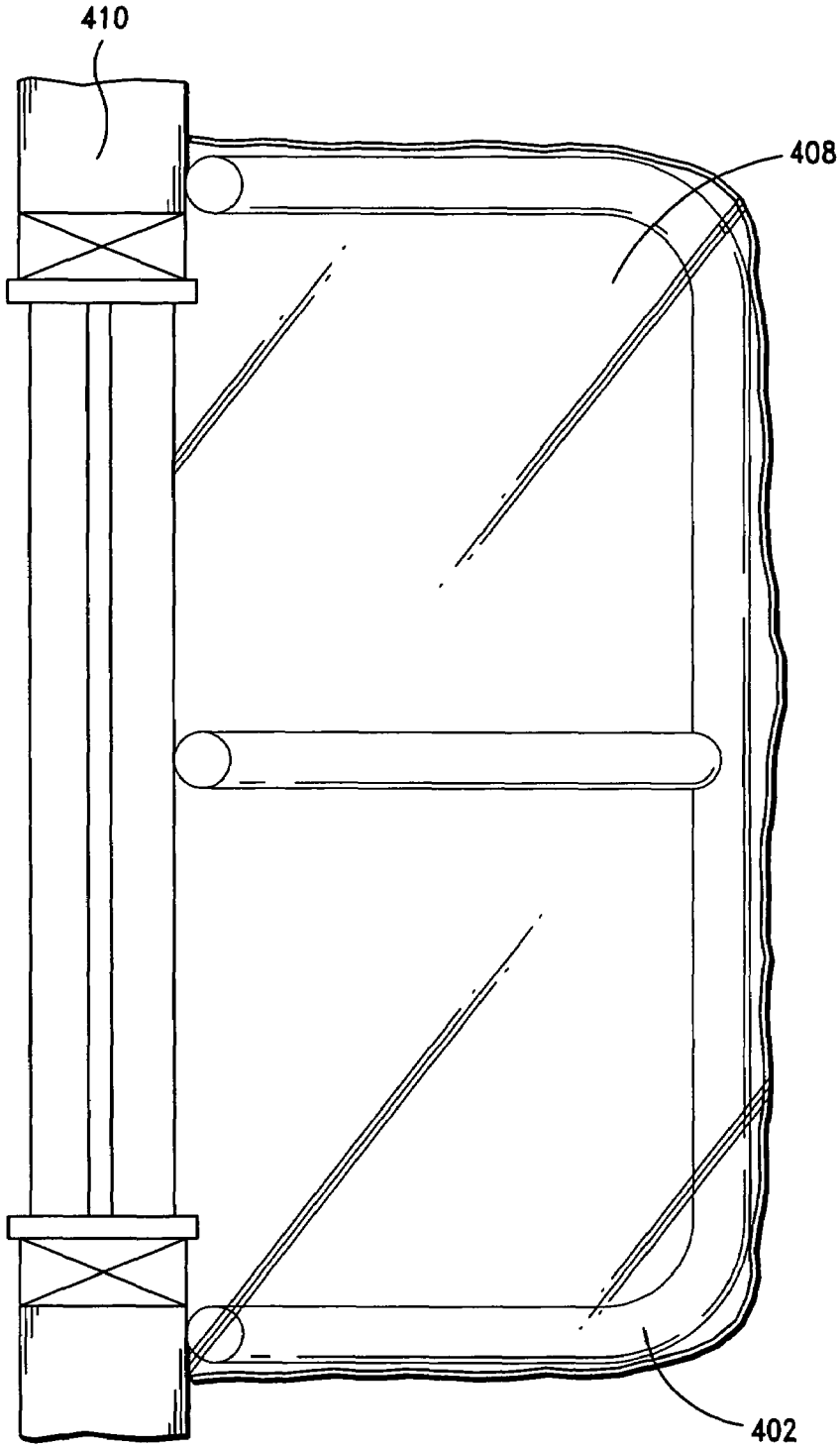
FIG. 9 is a side sectional view of the tent structure of FIG. 6.

Looking now to FIGS. 8 and 9, a protective tent 400 used in accordance with the method of the present invention allows repairs to be made to structural members even in inclement weather. Tent 400 includes a frame 402 comprised of individual horizontal support members 404 and vertical support members 406. Preferably support members 404, 406 are made from adjustable tubular material, most preferably they are three-quarter inch tubing, affixed together using screws or nails. A transparent protective wrap 408 covers the frame to form an enclosed tent. Preferably, protective wrap 408 is a transparent plastic, most preferably it is 2 mil Visqueen® brand plastic sheeting. Placing protective tent 400 against a building structure, such as a wall 410 or window, provides protection to the structural members under the tent, allowing repairs in accordance with the present invention to be completed regardless of the weather conditions.

The method of the present invention thus provides for a permanent, structurally sound repair of rotted wood damage in structural members. The use of a fungicide diminishes the fungi that propagates the wood rot, thus minimizing any further wood rot damage. The use of structural reinforcements within the repair area provide structural strength to the repaired structural member, as well as providing structure for strengthening filler material placed in the repair area. A structural member treated according to the present invention will add structural strength to the member, and the further decay of the member will be eliminated or minimized. In addition, the method of the present invention provides for performing repairs even in inclement weather by using a protective tent to protect the structural members under repair.

From the foregoing it will be seen that this invention is one well adapted to attain all ends and objectives herein-above set forth, together with the other advantages which are obvious and which are inherent to the invention.

Since many possible embodiments may be made of the invention without departing from the scope thereof, it is to be understood that all matters herein set forth or shown in the accompanying drawings are to be interpreted as illustrative, and not in a limiting sense.

While specific embodiments have been shown and discussed, various modifications may of course be made, and the invention is not limited to the specific forms or arrangement of parts and steps described herein, except insofar as such limitations are included in the following claims. Further, it will be understood that certain features and subcombinations are of utility and may be employed without reference to other features and subcombinations. This is contemplated by and is within the scope of the claims.

What is claimed and desired to be secured by Letters Patent is as follows:

1. A method of repairing wood rot in a structural member, comprising:

identifying rotted material in said structural member;

removing said rotted material from said structural member to create a repair area;

treating said repair area with a fungicide;

applying hardener to said repair area;

placing at least one reinforcement member in said repair area, said placing comprising inserting at least two screws into said repair area and attaching wire between said screws such that said wire is elevated within said repair area; and filling said repair area with filler material.

2. The method of claim 1, wherein said screws are inserted such that they are separated from one another by no more than one-half inch.

3. The method of claim 1, wherein said wire is eighteen gauge wire.

4. The method of claim 1, wherein said attaching wire comprises:

wrapping an end of said wire around a first screw;

routing said wire to a second screw; and wrapping said wire around said second screw.

5. The method of claim 4, further comprising:

tightening said wire to create a tension force between said screws.

6. A method of repairing wood rot in a structural member, comprising:

identifying rotted material in a structural member;

removing said rotted material from said structural member to create a repair area;

treating said repair area with a fungicide, said fungicide comprising approximately two parts muriatic acid and one part water;

applying hardener to said repair area;

placing at least two screws in said repair area, said screws separated from one another by no more than one-half inch;

attaching wire between said screws within the repair area such that said wire is elevated within said repair area; and filling said repair area with filler material.

7. The method of claim 6, further comprising:

tightening said wire to create a tension force between said screws.

8. The method of claim 6, further comprising shaping said filler material to conform to a shape of said structural member.

9. The method of claim 6, further comprising:

shielding said structural member using a protective tent.

* * * * *